US007494013B2

(12) United States Patent
Kao

(10) Patent No.: US 7,494,013 B2
(45) Date of Patent: Feb. 24, 2009

(54) CARDBOARD CUSHION

(75) Inventor: Chi-Shih Kao, Taipei (TW)

(73) Assignee: Asustek Computer Inc., Taipei (TW)

( * ) Notice: Subject to any disclaimer, the term of this patent is extended or adjusted under 35 U.S.C. 154(b) by 273 days.

(21) Appl. No.: 11/431,557

(22) Filed: May 11, 2006

(65) Prior Publication Data

US 2006/0291824 A1 Dec. 28, 2006

(30) Foreign Application Priority Data

May 20, 2005 (TW) ..... 94116464 A

(51) Int. Cl.
*B65D 81/02* (2006.01)

(52) U.S. Cl. ..... 206/588; 206/586; 206/592

(58) Field of Classification Search ..... 206/320, 206/521, 586–588, 590–592, 594
See application file for complete search history.

(56) References Cited

U.S. PATENT DOCUMENTS 5,322,168 A * 6/1994 Kataoka ..... 206/588
5,398,808 A * 3/1995 Chen et al. ..... 206/320
5,772,025 A * 6/1998 Chen et al. ..... 206/320
5,979,659 A * 11/1999 Kataoka ..... 206/588
6,843,374 B1 * 1/2005 Li et al. ..... 206/587
6,997,323 B2 * 2/2006 Maresh et al. ..... 206/592

* cited by examiner

*Primary Examiner*—Bryon P Gehman
(74) *Attorney, Agent, or Firm*—Birch, Stewart, Kolasch & Birch, LLP

(57) ABSTRACT

A cushion, which is a solid structure formed by a cardboard, includes a first baseboard, a second baseboard, a third baseboard, a fourth baseboard, a fifth baseboard and at least one supporting board that are joined to each other. Those junctions are foldable. The fourth baseboard has a first baffle flap and a plurality of the first cut lines. The fifth baseboard has a second baffle flap and a plurality of the second cut lines. When the first baffle flap and the second baffle flap are side matched to form the solid structure, the portion of the fourth baseboard between the first cut lines and the portion of the fifth baseboard between the second cut lines are folded toward each other to form a concave. The supporting board is joined to a lateral side of the opening of the solid structure and folded to be a supporting structure to cover the opening.

14 Claims, 5 Drawing Sheets

CARDBOARD CUSHION

BACKGROUND OF THE INVENTION

1. Field of Invention

The invention relates to a cushion and, in particular, to a cushion designed as an integrated structure.

2. Related Art

Nowadays, the electronic products such as computers, scanners, and computer peripherals become the indispensable equipments in the modern life. In order to protect the electronic products from being damaged on the shipping way, the corners and edges of the electronic products must be supported and protected with buffer materials before the electronic apparatus are put into the carton.

Regular buffer materials for aforesaid purpose are commonly molded from foamed plastics. However, with raising the environmental consciousness, the cardboards have been intensively used for packing the electronic products so that the environmental pollutions can be reduced and the protection purpose is attained concurrently.

With reference to FIG. 1, the conventional cushion 1 made of the cardboard comprises a bearing base 11, and a plurality of fastened elements 12. The bearing base 11 is formed by folding a cardboard. The bearing base 11 has a bottom wall 111 and two lateral walls 112. The lateral walls 112 are respectively disposed at the opposite sides of the bottom wall 111 and perpendicular to the bottom wall 111. Two slots 113 are disposed near two opposite ends of the bottom wall 111. The fastened elements 12 are also respectively formed by folding a cardboard. Each of the fastened elements 12 has a plurality of the slots 121 used to be engaged with the slots 113 of the bearing base 111 so that the lateral walls 112 can be fixed on the fastened elements 12. Therefore, referring to the FIG. 2, two cushions 1 can be respectively disposed at two opposite ends of a product 2 to protect the product 2 from impact.

However, only the fastened elements 12 are used to fix the two ends of the bearing base 11, which is a simple structure, so that the conventional cushion 1 is easy to be damaged during the long-time shipment. In addition, because the cushion 1 is assembled by a plurality of components, the assembling procedures are complex, resulting in more manufacturing time and higher cost.

Therefore, according to the above-mentioned problems, it is a subjective to provide a cushion with a rigid structure, which is easily assembled and has lower manufacturing cost.

SUMMARY OF THE INVENTION

In view of the foregoing, the invention is to provide a cushion having a rigid structure, simple assembled procedures, and lower manufacturing cost.

To achieve the above, a cushion of the invention, which is a solid structure formed by a cardboard, includes a first baseboard, a second baseboard, a third baseboard, a fourth baseboard, a fifth baseboard, and at least one supporting board. In this case, the second baseboard is joined to a lateral side of the first baseboard. The first baseboard and the second baseboard are foldable along the junction line of the first baseboard and the second baseboard. The third baseboard is joined to another lateral side of the first baseboard. The first baseboard and the third baseboard are foldable along the junction line of the first baseboard and the third baseboard. The fourth baseboard is joined to a lateral side of the second baseboard. The second baseboard and the fourth baseboard are foldable along the junction line of the fourth baseboard and the second baseboard. A first baffle flap is disposed at a lateral side of the fourth baseboard and a plurality of first cut lines are formed in parallel with each other on the fourth baseboard. The fifth baseboard is joined to a lateral side of the third baseboard. The third baseboard and the fifth baseboard are foldable along the junction line of the fifth baseboard and the third baseboard. A second baffle flap is disposed at a lateral side of the fifth baseboard, and a plurality of second cut lines are formed in parallel with each other on the fifth baseboard. When the first baffle flap and the second baffle flap are connected and side matched to form the solid structure, the portion of the fourth baseboard between the first cut lines and the portion of the fifth baseboard between the second cut lines are folded toward each other to form a concave. The first baffle flap and the second baffle flap are substantially perpendicular to a bottom wall of the concave and a lateral side of the solid structure has an opening. The supporting board is joined to a lateral side of the opening and folded to be a supporting structure to cover the opening.

As mentioned above, the cushion of the invention is a solid (3-D) structure formed with a plurality of baseboards. In addition, the portions of the fourth baseboard and the fifth baseboard are folded toward each other to form a concave. The opening at the lateral side of the solid structure is covered by at least one folded supporting board. Compared with the prior art, the solid structure of the cushion of the invention is strengthened. Additionally, because the cushion of the invention is manufactured by folding a cardboard to form an integrated structure, the assembling procedures are simplified and the manufacturing cost is reduced.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
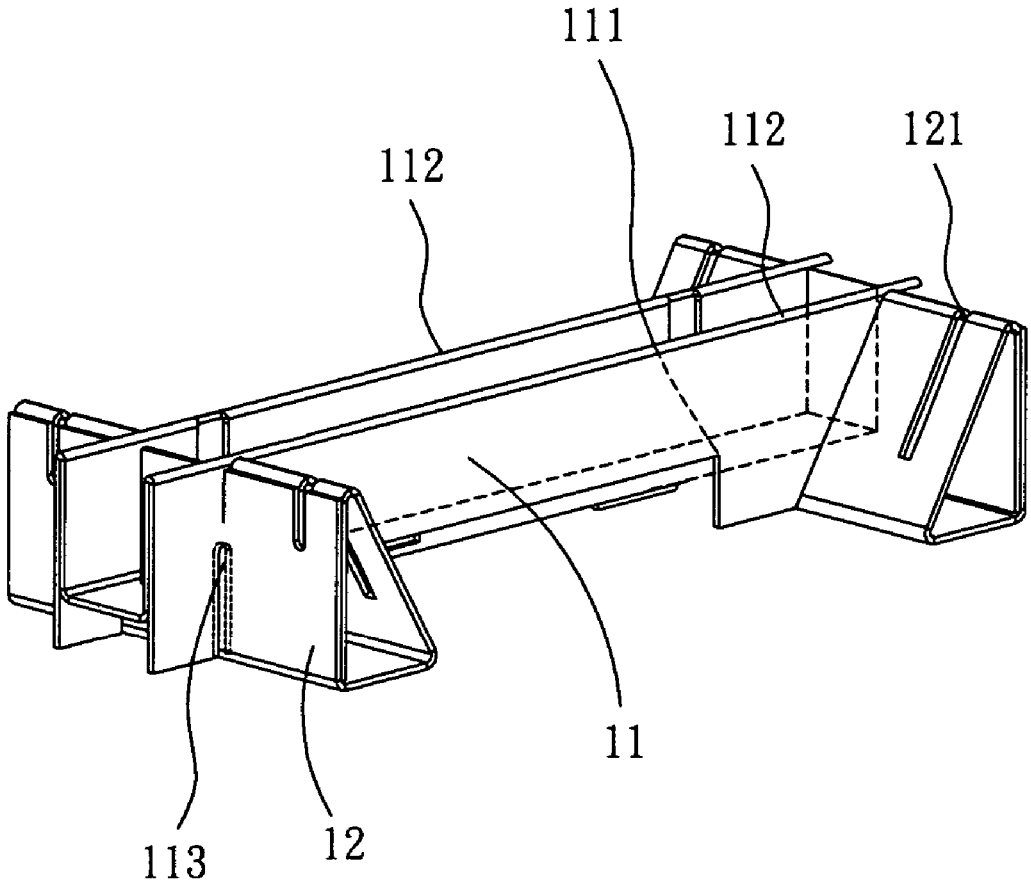
PRIOR ART FIG. 1
FIG. 1 is a schematic view showing the conventional cushion.
Figure 2:
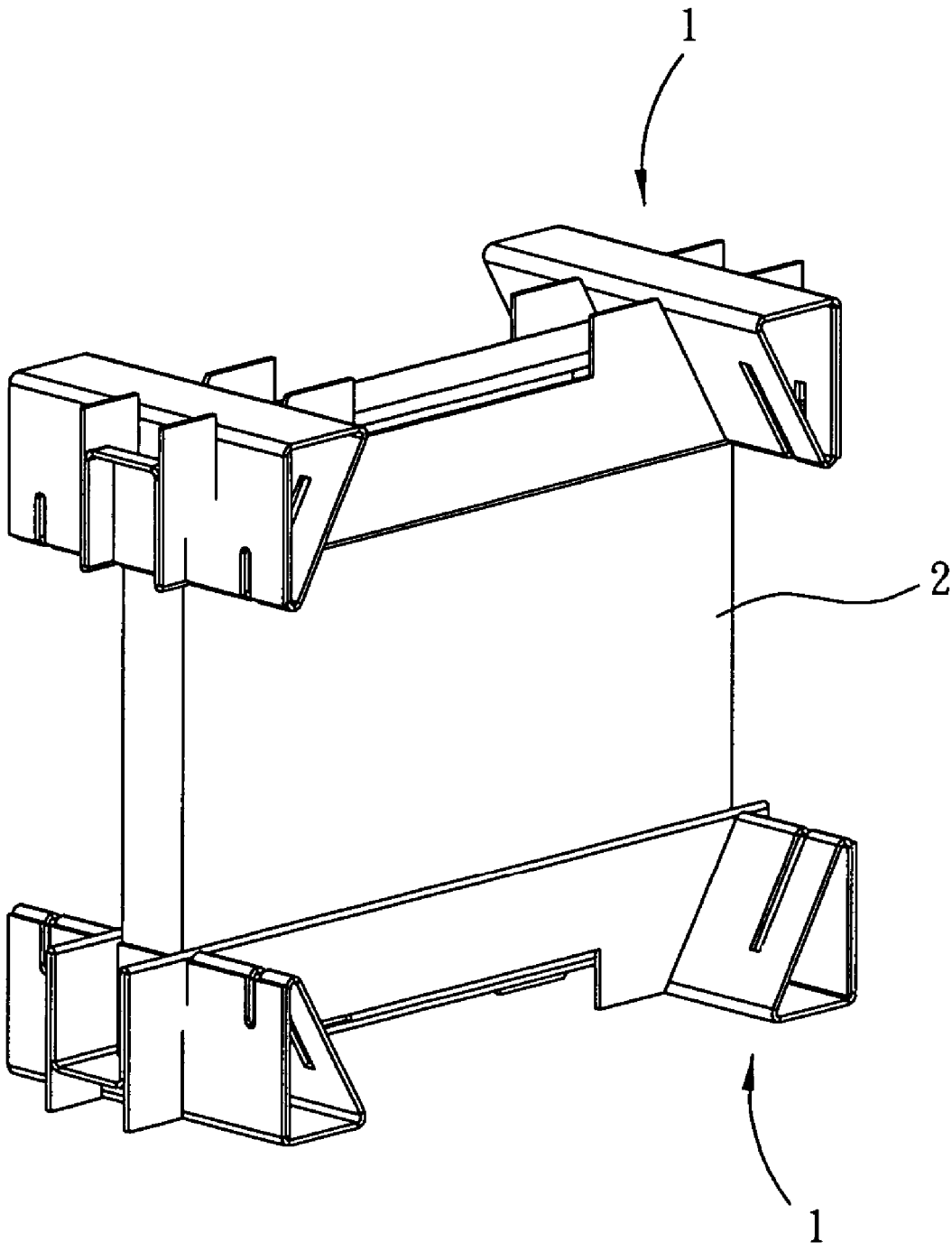
PRIOR ART FIG. 2
FIG. 2 is a schematic view showing the conventional cushion that is in use.
Figure 3:
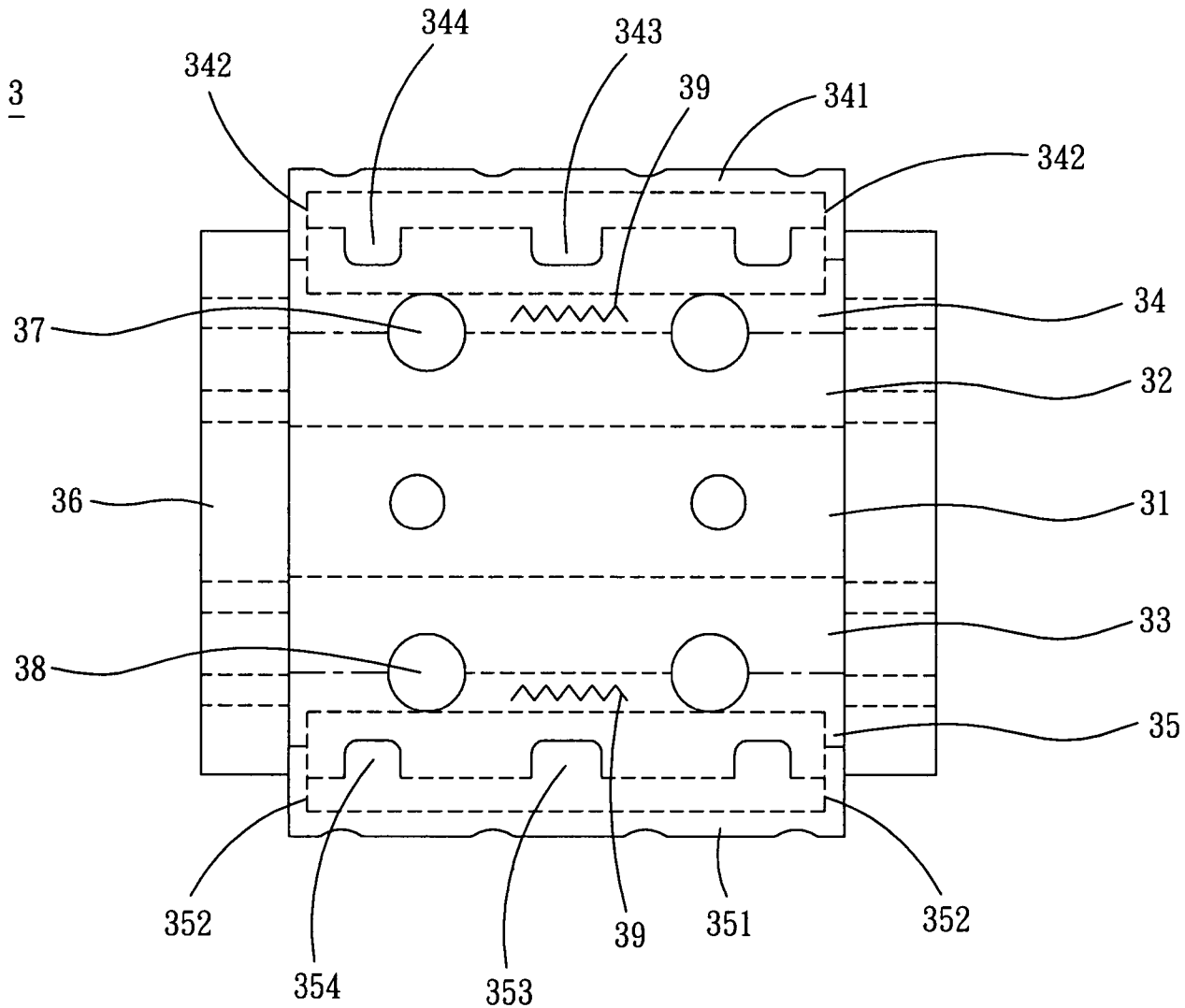
FIG. 3 is a schematic development view showing a cushion according to a preferred embodiment of the invention.

With reference to FIG. 3, the cushion 3 according to the preferred embodiment of the invention includes a first baseboard 31, a second baseboard 32, a third baseboard 33, a fourth baseboard 34, a fifth baseboard 35, and at least one supporting board 36.

The second baseboard 32 is joined to a lateral side of the first baseboard 31. The first baseboard 31 and the second baseboard 32 can be folded along the junction line of the first baseboard 31 and the second baseboard 32. The third baseboard 33 is joined to another lateral side of the first baseboard 31. The first baseboard 31 and the third baseboard 33 are foldable along the junction line of the first baseboard 31 and the third baseboard 33. The fourth baseboard 34 is joined to a lateral side of the second baseboard 32. The second baseboard 32 and the fourth baseboard 34 are foldable along the junction line of the fourth baseboard 34 and the second baseboard 32. The fifth baseboard 35 is joined to a lateral side of the third baseboard 33. The third baseboard 33 and the fifth baseboard 35 are foldable along the junction line of the fifth baseboard 35 and the third baseboard 33.

As mentioned above, a first baffle flap 341 is disposed at a lateral side of the fourth baseboard 34, and a plurality of first cut lines 342 is formed in parallel with each other on the fourth baseboard 34. A second baffle flap 351 is disposed at a lateral side of the fifth baseboard 35, and a plurality of second cut lines 352 are formed in parallel with each other on the fifth baseboard 35. In this case, at least one side of the first baffle flap 341 or at least one side of the second baffle flap 351 has a wavy structure.

In addition, at least one first tongue flap 344 is formed between the parallel first cut lines 342 of the fourth baseboard 34 and is defined by at least one third cut line 343. At least one second tongue flap 354 is formed between the parallel second cut lines 352 of the fifth baseboard 35 and is defined by at least one fourth cut line 353.

Additionally, at least one first buffer hole 37 is formed at the junction of the second baseboard 32 and the fourth baseboard 34. At least one second buffer hole 38 is formed at the junction of the third baseboard 33 and the fifth baseboard 35. Herein, the first buffer hole 37 or the second buffer hole 38 can be in a circular shape.

The fourth baseboard 34 or the fifth baseboard 35 has at least one incision line 39. In the present embodiment, the incision line 39 can be a curve line, such as a sawtooth line or a wavy line.

Figure 4:
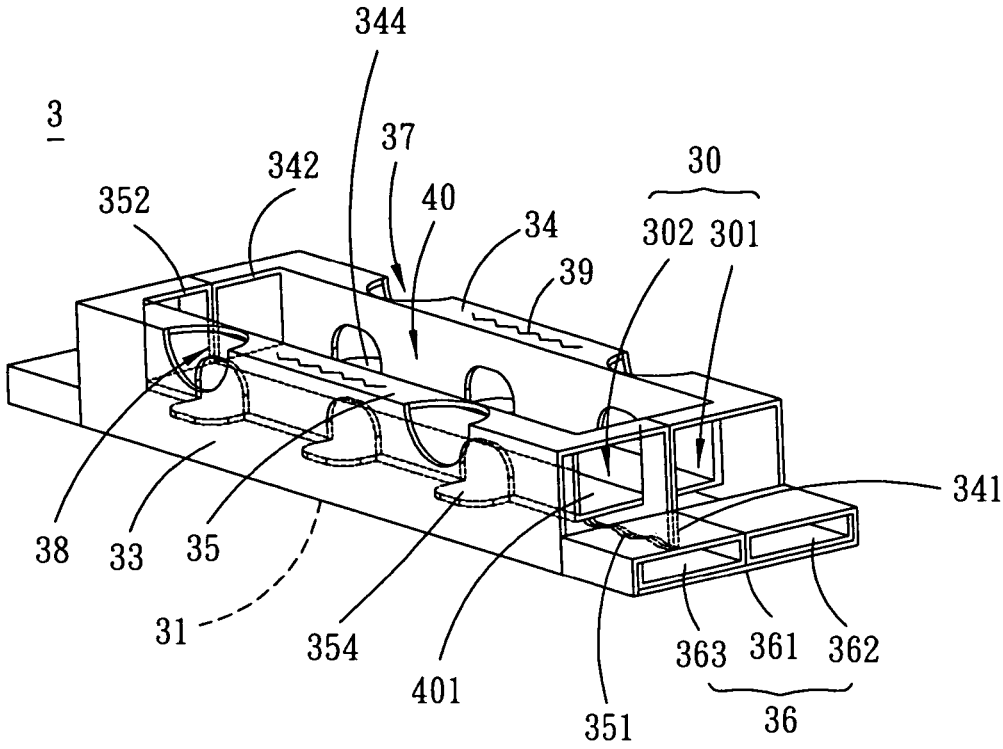
FIG. 4 is a schematic view showing a partially folded cushion according to a preferred embodiment of the invention.

With reference to FIG. 4, the cushion 3 of the present embodiment is manufactured by folding a cardboard to form an integrated structure. Specifically, after folding the cardboard, the first baffle flap 341 of the fourth baseboard 34 is connected to and in parallel to the second baffle flap 351 of the fifth baseboard 35 such that the solid structure is formed and a lateral side of the solid structure has an opening 30. The portion of the fourth baseboard 34 between the first cut lines 342 and the portion of the fifth baseboard 35 between the second cut lines 352 are folded toward each other to form a concave 40. Herein, the first baffle flap 341 and the second baffle flap 351 are substantially perpendicular to a bottom wall 401 of the concave 40. The top ends of the first baffle flap 341 and the second baffle flap 351 are against the first baseboard 31. The first tongue flap 344 and the second tongue flap 354 are respectively disposed at the opposite lateral sides of the bottom wall 401 of the concave 40.

Figure 5:
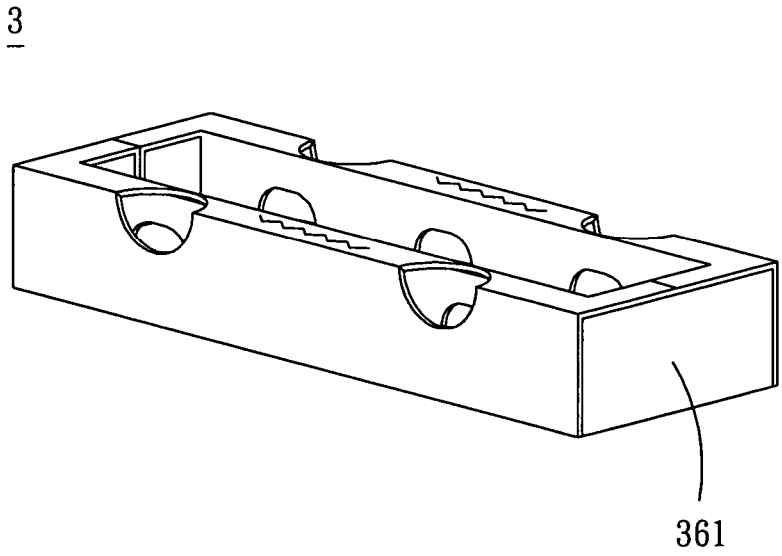
FIG. 5 is a schematic view showing a folded cushion according to a preferred embodiment of the invention.

The supporting board 36 is joined to a lateral side of the opening 30 and folded to form a supporting structure to cover the opening 30. In the present embodiment, the opening 30 of the solid structure has a first portion 301 and a second portion 302. The supporting board 36 has a lateral wall 361, a first box unit 362 and a second box unit 363. One side surface of the first box unit 362 and one side surface of the second box unit 363 face to and are connected with the lateral wall 361. In this case, with reference to FIG. 5, the first box unit 362 is inserted into the first portion 301 of the opening 30 while the second box unit 363 is inserted into the second portion 302 of the opening 30.

Figure 6:
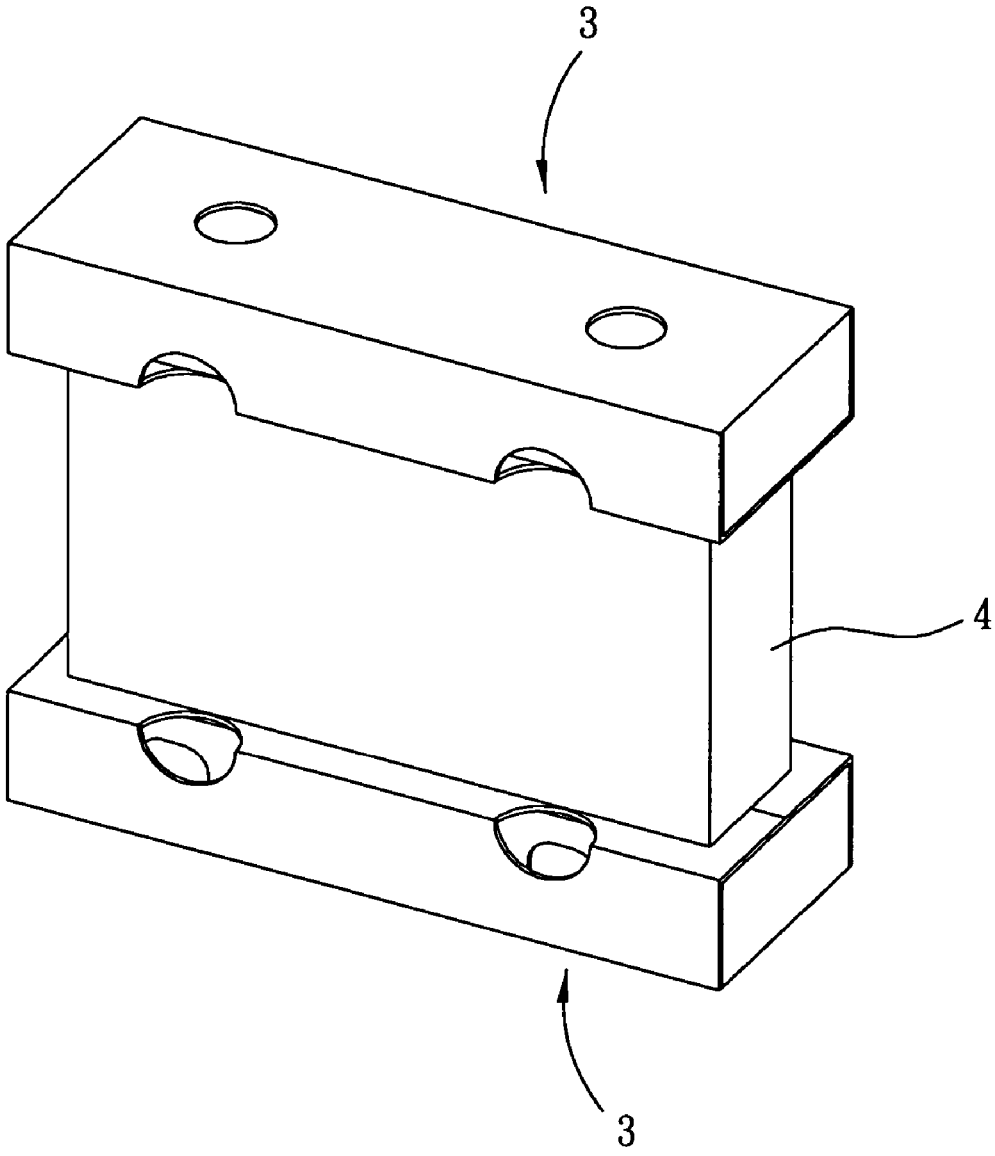
FIG. 6 is a schematic view showing a cushion according to a preferred embodiment of the invention that is in use.

As mentioned above, the concave 40 is used to receive a product 4. For instance, two cushions 3 according to the preferred embodiment of the invention are disposed at the two opposite ends of the product 4 (as shown in FIG. 6). With reference to FIG. 4, the wavy structures of the first baffle flap 341 and the second baffle flap 351 can be used to buffer stress which is applied to the product 4. Typically, the greater the amplitude of the wavy structure, the greater effect on absorbing impact can be. Additionally, the first buffer hole 37, the second buffer hole 38 and the incision lines 39 are also used to absorb impact. Moreover, the first tongue flap 344 and the second tongue flap 354 are provided to support the cushion 3 so that the structure strength of the solid structure of the cushion 3 is enhanced.

In conclusion, the cushion of the invention is a solid structure formed with a plurality of baseboards. In addition, the portions of the fourth baseboard and the fifth baseboard are folded toward each other to form a concave. The opening at the lateral side of the solid structure is covered by at least one folded supporting board. Compared with the prior art, the solid structure of the cushion of the invention is strengthened. Additionally, because the cushion of the invention is manufactured by folding a cardboard to form an integrated structure, the assembling procedures are simplified and the manufacturing cost is reduced.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A cushion, which is a solid structure formed by a cardboard, comprising:

a first baseboard;

a second baseboard, which is joined to a lateral side of the first baseboard, wherein the first baseboard and the second baseboard are foldable along the junction line of the first baseboard and the second baseboard;

a third baseboard, which is joined to another lateral side of the first baseboard, wherein the first baseboard and the third baseboard are foldable along the junction line of the first baseboard and the third baseboard;

a fourth baseboard, which is joined to a lateral side of the second baseboard, wherein the second baseboard and the fourth baseboard are foldable along the junction line of the fourth baseboard and the second baseboard, a first baffle flap is disposed at a lateral side of the fourth baseboard, and a plurality of first cut lines are formed in parallel with each other on the fourth baseboard;

a fifth baseboard, which is joined to a lateral side of the third baseboard, wherein the third baseboard and the fifth baseboard are foldable along the junction line of the fifth baseboard and the third baseboard, a second baffle flap is disposed at a lateral side of the fifth baseboard, and a plurality of second cut lines are formed in parallel with each other on the fifth baseboard, and wherein when the first baffle flap and the second baffle flap are connected and side matched to form the solid structure, the portion of the fourth baseboard between the first cut lines and the portion of the fifth baseboard between the second cut lines are folded toward each other to form a concave, the first baffle flap and the second baffle flap are substantially perpendicular to a bottom wall of the concave, and a lateral side of the solid structure has an opening; and at least one supporting board, which is joined to a lateral side of the opening and folded to be a supporting structure to cover the opening.

2. The cushion of claim 1, wherein at least one first buffer hole is formed at the junction of the second baseboard and the fourth baseboard.

3. The cushion of claim 2, wherein the at least one first buffer hole is respectively in a circular shape.

4. The cushion of claim 1, wherein at least one second buffer hole is formed at the junction of the third baseboard and the fifth baseboard.

5. The cushion of claim 4, wherein the at least one second buffer hole is respectively in a circular shape.

6. The cushion of claim 1, wherein one of the fourth baseboard and the fifth baseboard has at least one incision line.

7. The cushion of claim 6, wherein the at least one incision line is a curve line.

8. The cushion of claim 6, wherein the at least one incision line is a wavy line.

9. The cushion of claim 6, wherein the at least one incision line is a saw-toothed line.

10. The cushion of claim 1, wherein at least one side of the first baffle flap or at least one side of the second baffle flap has a wavy structure.

11. The cushion of claim 1, wherein at least one first tongue flap is formed between the first cut lines of the fourth baseboard and the at least one first tongue flap is defined by at least one third cut line.

12. The cushion of claim 1, wherein at least one second tongue flap is formed between the second cut lines of the fifth baseboard and the at least one second tongue flap is defined by at least one fourth cut line.

13. The cushion of claim 1, wherein the opening has a first portion and a second portion.

14. The cushion of claim 13, wherein the supporting structure has a lateral wall, a first box unit and a second box unit, one side of the first box unit and one side of the second box unit face to the lateral wall, the first box unit is inserted into the first portion of the opening, and the second box unit is inserted into the second portion of the opening.

* * * * *